United States Patent [19]

Luthi

[11] 4,098,642

[45] Jul. 4, 1978

[54] PRESSURE PULP WASHER WITH INLET PIVOT

[75] Inventor: Oscar Luthi, Nashua, N.H.

[73] Assignee: Ingersoll-Rand Company, Woodcliff Lake, N.J.

[21] Appl. No.: 779,147

[22] Filed: Mar. 18, 1977

[51] Int. Cl.[2] ..... D21F 1/04; D21F 1/60

[52] U.S. Cl. ..... 162/259; 68/43; 100/121; 162/317; 162/329

[58] Field of Search ..... 162/60, 210, 214, 289, 162/311, 317, 324, 327, 328, 329, 259; 8/156; 68/43; 100/121; 210/402

[56] References Cited

U.S. PATENT DOCUMENTS

| | | | |
|---|---|---|---|
| 3,065,787 | 11/1962 | Rescheneder | 162/327 |
| 3,772,144 | 11/1973 | Luthi et al. | 162/210 |

FOREIGN PATENT DOCUMENTS

| | | | |
|---|---|---|---|
| 1,431,908 | 2/1968 | France | 162/317 |

*Primary Examiner*—Richard V. Fisher
*Attorney, Agent, or Firm*—Frank S. Troidl

[57] ABSTRACT

A high consistency pulp slurry is prevented from floccing by at least one pivotable member located in the vat at the area where the pulp slurry leaves the inlet box and enters the vat. The pivotable member is located with respect to the inner surface of the vat and is structured to speed-up the pulp slurry as it enters the vat to prevent floc formations.

If pulp fibers should become stuck in the small space between the outer surface of the pivotable member and the inner surface of the vat, the pivotable member will automatically pivot away from the inner surface of the vat, thereby automatically loosening the stuck fibers. As soon as the stuck fibers are loosened, the pivotable member will return to its initial position.

3 Claims, 4 Drawing Figures

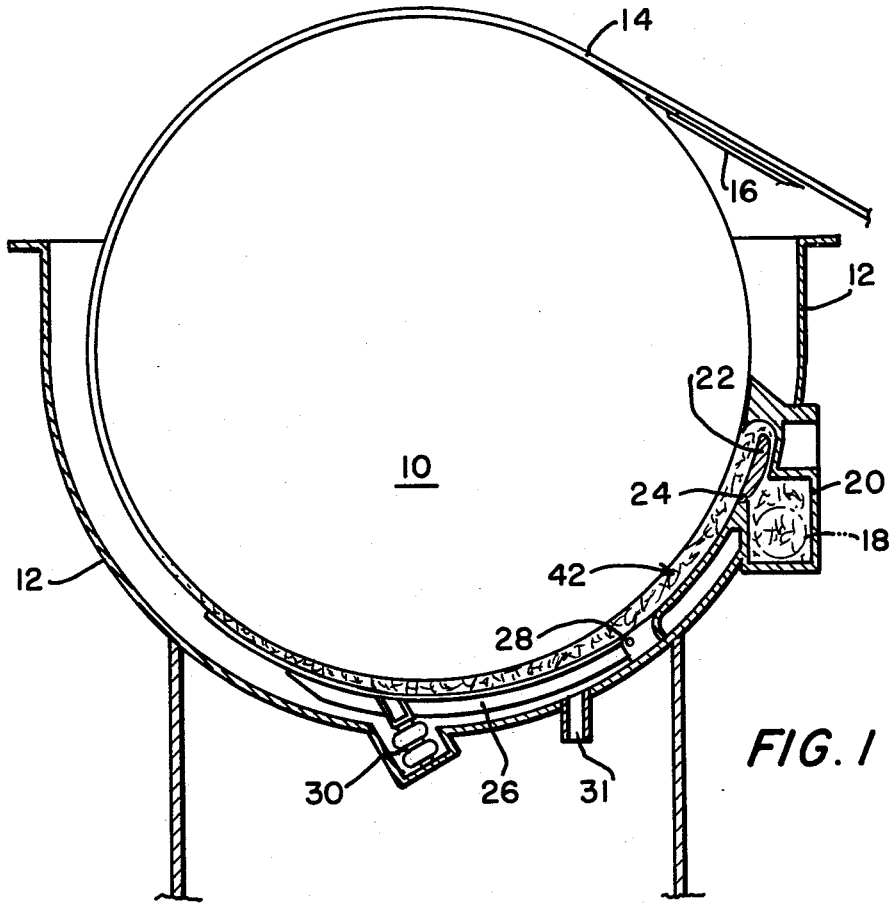
FIG. 1
FIG. 4
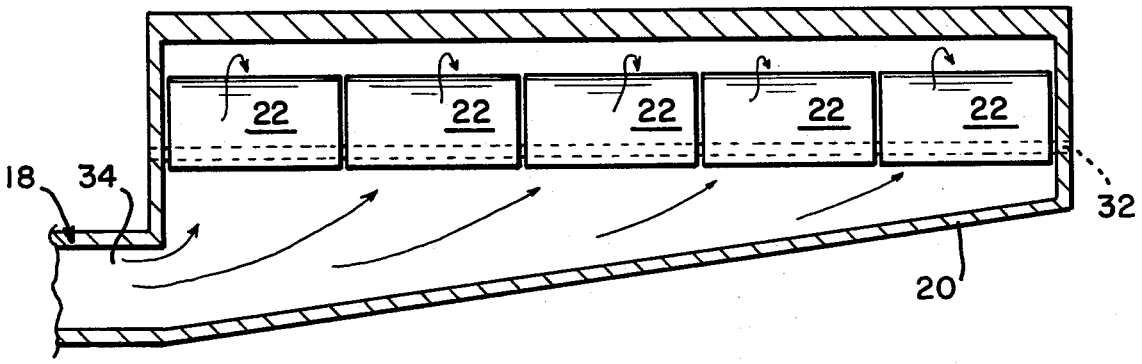

PRESSURE PULP WASHER WITH INLET PIVOT

This invention relates to pulp and paper technology. More particularly, this invention is a new and improved pulp sheet forming device.

In a currently used method of making pulp from wood stock, the wood, which may be in the form of wood chips, is heated in a digester. In the digester, the lignin is chemically dissolved and heated to free the cellulose fibers so that they can be reformed into paper.

The cooked pulp fibers are then blown into a tank where the steam flashes off. Black liquor is added to the blow tank to dilute the stock in the blow tank to, say 3½ to 4% consistency. The diluted stock is pumped from the blow tank to the washers. However, before the pulp slurry is fed to the washers, it must be first further diluted to 1% consistency at the washer head box for good sheet formation on the cylinder.

One reason why the pulp slurry must be decreased to the approximately 1% consistency is that a well formed mat in the washer is essential for good washing efficiency. With currently used washers, the pulp in the vat has a tendency to form flocs if the consistency of the pulp slurry is above about 1½%. This results in a lumpy sheet formation and poor washing efficiency. Other disadvantages are that it is very difficult to obtain an even pulp distribution over the total cylinder length of the washer, and partial or complete plugging of the inlet box or vat is very likely to occur, especially at start-up.

This invention is a new pulp sheet forming device which will permit the feeding of pulp slurry to the device with the pulp slurry having as much as 4% consistency. The 4% consistency is a practical limit for centrifugal pumps and reasonable pipeline frictions. The advantages of increasing the pulp consistency from 1 to 4% are, among other things, the quantity of liquor in circulation is reduced to ¼, resulting in much less pumping horsepower, smaller pumps and smaller pipes. If less liquor is needed, the increased capacity of the washer results in smaller, less expensive cylinders.

Briefly described, this invention is a pulp sheet former with a cylinder which may be rotated in a vat containing pulp slurry. At least one pivotable member is pivotably mounted in the vat at the area where the pulp slurry leaves the inlet box and enters the vat. The pivotable member is spaced from the inner surface of the vat and has a radial outer surface shaped to speed-up the slurry flow between the outside of the pivotable member and the inside of the vat. This minimizes the forming of flocs and breaks up formed flocs.

The invention, as well as its many advantages, may be further understood by reference to the following detailed description and drawings in which:

FIG. 1 is a front schematic view, partly in section, showing the new washer;

Figure 2:
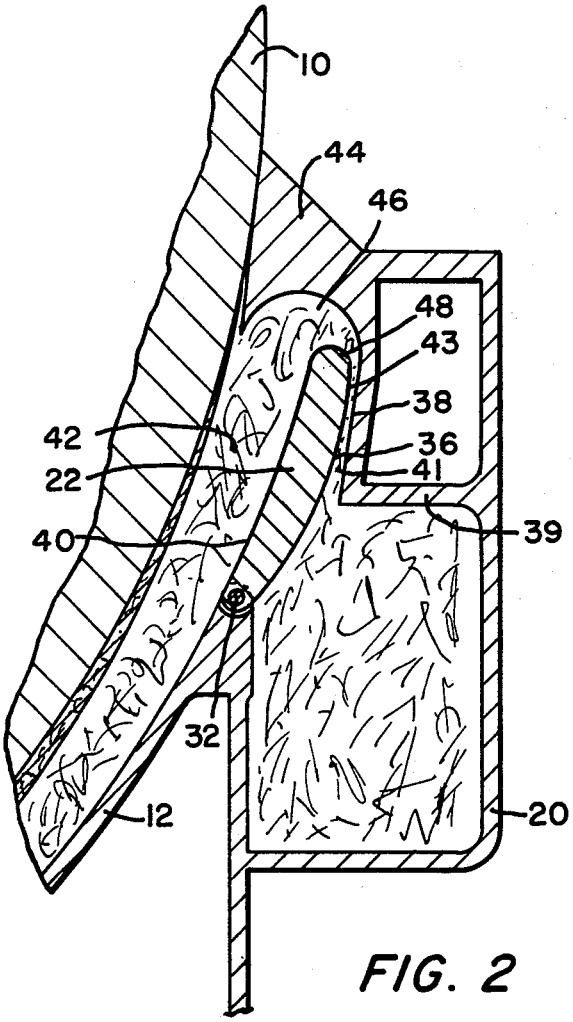
FIG. 2 is a front sectional view, on an enlarged scale, showing a pivotable member in the normal position for the flow of pulp slurry to the washer.
Figure 3:
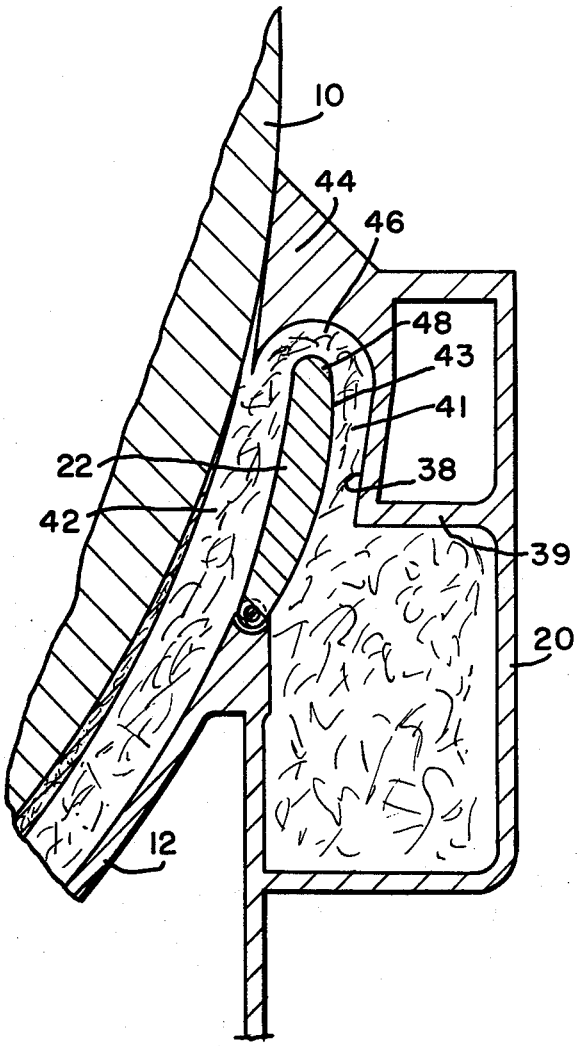

FIG. 3 is a view similar to FIG. 2 showing the pivotable member in the open position which is the position at start-up and the position which automatically occurs in the event fibers should become stuck in the space between the pivotable member and the inside surface of the vat; and FIG. 4 is a sectional view on a reduced scale showing the tapered pulp slurry inlet box and plurality of pivotable members.

In the various Figures, like parts are referred to by like numbers.

Referring to the Figures, and particularly to FIG. 1, the vacuum or pressure washer is a wire cloth covered cylinder 10 which rotates in a vat 12 containing the pulp slurry. The lower section of the drum 10 is submerged in the pulp. By means of internal valving (not shown), a vacuum or differential pressure is applied as the rotating cylinder enters the pulp slurry. The black liquor drains inwardly through the wire cloth (not shown), leaving a layer of pulp 14 on the face of the wire and the pulp layer is held there by the vacuum inside the cylinder. As the cylinder 10 continues to rotate, the thick layer of pulp adhering to the face wire emerges from the slurry. Black liquor continues to drain from the pulp as a result of the differential pressure between the external atmosphere and the vacuum within the cylinder. Finally, the vacuum is cut off and the washed pulp sheet 14 is removed from the wire of the cylinder by the scraper 16 just before the cycle is repeated.

The pulp slurry, which may be as high in consistency as 4%, is fed through a pulp conduit 18 into the pulp slurry inlet box 20. The pulp slurry then flows around the pivotable member 22 which may pivot about pivot 24 and into the space 42 between the outside periphery of rotatable cylinder 10 and the inside surface of the vat 12.

The pulp slurry begins to form the sheet 14 in the forming area extending from approximately 4 O'clock to approximately 5 O'clock. A compacting shoe 26 pivotably mounted downstream from the pulp slurry inlet box 20 by pivot 28 applies a compacting force against the sheet being formed by means of a small actuator 30. Wash water enters vat 12 through wash water inlet 31. Water showers (not shown) may also be used to apply wash water to the sheet 14 just before the sheet is removed by scraper 16.

Preferably, a plurality of pivotable members 22 are arranged along the entire length of the cylinder 10 (see FIG. 4). The pivotable members 22 may all be pivotable about a single pivot pin 32. As shown in FIG. 4, the inlet box 20 preferably is a tapered inlet box to assure that the velocity of the entering pulp slurry does not decrease as the pulp particles or fibers move from the entrance 34 of the pulp slurry inlet box 20 toward the right hand side of the inlet box, looking at FIG. 4. The tapered portion tends to speed-up the flow of the pulp slurry in the narrower regions, thereby keeping up the velocity to prevent the fibers in the high consistency pulp from floccing or settling.

Referring specifically to FIG. 2, it can be seen that the spacing of the radial outer surface 36 of the pivotable member 22 from the inside surface 38 of the vat provides a small gap for the pulp slurry to flow through. In the particular embodiment shown, the radial outer surface of the pivotable member and the inner surfaces 38 and 39 are constructed to provide a sudden contraction at 41 followed by a divergent gap 43 to speed-up the slurry flow at 41. This speeding-up of the pulp flow minimizes the forming of floc and will break up any flocs which may have been formed in the pulp slurry inlet box 20.

The radial inner surface 40 of the pivotable member 22 may be slightly curved to conform with the curvature of the rotatable drum 10, or may be a straight surface, or any other desired shape. The radial inner surface 40 of the pivotable member 22 is spaced from the outside of the cyliner 10 a predetermined distance. The aforementioned means for establishing a pressure in the space 42 between the radial inner surface of the pivotable member 22 and the outer surface of the cylinder 10 is controlled to be a predetermined pressure so that in the event one or more of the pivotable members 22 should have fibers become stuck in the small space 41 between the radial outer surface 36 and the inner surface 38 of the vat, the increased pressure in the small space will automatically pivot that pivotable member 22 toward the cylinder 10 and away from the vat inside surface 38 to the position in FIG. 3. As soon as the flow again begins on the outside radial surface of that particular pivotable member 22, the pivotable member will automatically return to the initial position shown in FIG. 2.

It is also essential when washing pulp of 4% consistency that the pulp be kept in agitation, even after it has passed around the pivotable members 22 and enters the space 42. To maintain the high velocity flow of the pulp slurry, a slurry flow reverser 44 is provided. The flow reverser 44 has a curved inner surface 46. The curved inner surface 46 is slightly spaced from the circumferentially outer surface 48 of the pivotable member 22 and is adapted to reverse the circumferential direction of flow of the slurry as it flows around the outer surface 48 of the pivotable member 22. This reversal of flow keeps the slurry agitated and prevents the reforming of flocs as the pulp slurry enters the space 42.

In operation, at start-up, the pivotable members 22 are in the open position shown in FIG. 3. As flow is increased, the pivotable members are pulled into the closed position shown in FIG. 2 by the hydraulic forces acting on it, thereby creating a small gap with a high velocity zone. A pressure drop of, say, 3 to 5 PSI may occur between the tapered pulp slurry inlet 20 and the washer vat. The increased flow will cause larger hydraulic forces which will tend to close the gap. Therefore, the pivoting member 22 together with the pressure drop maintains a very uniform flow over the total cylinder length.

Should a small area gap adjacent a particular pivotable member 22 get plugged by pulp or foreign particles, the flow will cease and the pivotable member will pivot into the open position, thereby releasing the plug.

Though this invention has been described as a washer for washing the pulp obtained from a blow tank, the washer may also be used between the various chemical treating stages in a bleaching process. Also, though the washer has been described in general as a vacuum washer, a pressure other than a vacuum may be maintained on the inside of the cylinder 10, providing the inside pressure is less than the outside pressure. The invention may also be used in forming vats of paper machines for forming pulp sheets.

I claim:

1. In a pressure washer with a cylinder rotatable in a vat containing pulp slurry: a pulp slurry inlet box; at least one pivotable member pivotally mounted in the vat at the area where the pulp slurry leaves the inlet box and enters the vat, the radial inner surface of the pivotable member being spaced from the cylinder a predetermined distance, and the radial outer surface of the pivotable member being spaced from an inner surface of the vat and said radial outer surface being shaped to speed-up slurry flow between the outside of the pivotable member and the inside surface of the vat to minimize the forming of flocs and to break up any formed flocs, and means for establishing a predetermined pressure in the space between the cylinder and the radial inner surface of the pivotable member such that if fibers become stuck between said inner surface of the vat and said radial outer surface of the pivotable member, the pivotable member will automatically pivot away from said inner surface of the vat and toward the cylinder to thereby free the stuck fibers, said pivotable member automatically returning to its initial position after the pulp fibers become loosened.

2. The pressure washer of claim 1 wherein: there is a plurality of separate longitudinally aligned pivotable members.

3. A pressure washer in accordance with claim 2 wherein: a pulp slurry flow reverser is connected to the vat and slightly spaced from the circumferentially outer surface of the pivotable members and adapted to reverse the circumferential direction of flow of the slurry as it flows around the circumferentially outer surface of each pivotable member to prevent the fibers from reforming flocs as the pulp slurry enters the space between the cylinder and the radial inner surface of the vat.

* * * * *